US007631652B2

(12) United States Patent
Archer, Jr.

(10) Patent No.: US 7,631,652 B2
(45) Date of Patent: Dec. 15, 2009

(54) FLUSH RINSE APPARATUS FOR ELECTROPLATING OPERATIONS

(76) Inventor: Harry L. Archer, Jr., 5213 Saint Genevieve Pl., Alexandria, VA (US) 22315

( * ) Notice: Subject to any disclaimer, the term of this patent is extended or adjusted under 35 U.S.C. 154(b) by 307 days.

(21) Appl. No.: 11/031,735

(22) Filed: Jan. 7, 2005

(65) Prior Publication Data

US 2006/0151012 A1 Jul. 13, 2006

(51) Int. Cl.
*B08B 3/02* (2006.01)

(52) U.S. Cl. ..... 134/61

(58) Field of Classification Search ..... 134/61
See application file for complete search history.

(56) References Cited

U.S. PATENT DOCUMENTS

| | | | | |
|---|---|---|---|---|
| 2,831,488 | A * | 4/1958 | Anderson | 134/138 |
| 4,269,208 | A | 5/1981 | Koering | 134/60 |
| 4,466,454 | A * | 8/1984 | Layton | 134/76 |
| 5,063,949 | A | 11/1991 | Yates | 134/60 |
| 5,419,355 | A * | 5/1995 | Brennan et al. | 137/1 |
| 5,707,457 | A | 1/1998 | Yates | 134/30 |
| 5,932,109 | A | 8/1999 | Griffen | 210/709 |
| 5,938,899 | A * | 8/1999 | Forand | 204/259 |
| 6,180,310 | B1 * | 1/2001 | Pinsly | 430/131 |
| 6,360,756 | B1 | 3/2002 | Chen et al. | 134/95.3 |
| 6,372,051 | B1 | 4/2002 | Adams et al. | 134/18 |
| 6,391,209 | B1 * | 5/2002 | Belongia et al. | 210/748 |
| 2003/0140406 | A1 * | 7/2003 | Miwa et al. | 4/420 |
| 2004/0195248 | A1 * | 10/2004 | Garcia | 220/570 |

* cited by examiner

*Primary Examiner*—Frankie L Stinson
*Assistant Examiner*—Samuel A Waldbaum
(74) *Attorney, Agent, or Firm*—Frederic Zimmerman

(57) ABSTRACT

An apparatus for rinsing an article includes a tank having an upper portion, the upper portion including a rim; a discharge pipe connected to the tank; a generally cylindrical spray assembly disposed in a middle portion of the tank; a second tank; a source of rinse fluid connected to the second tank and to the spray assembly through a valve, the valve being operable to open to both the second tank and the spray assembly when a level of rinse fluid in the second tank is decreasing and operable to close to both the second tank and the spray assembly when the level in the second tank is at a full level; a fluid connection between the second tank and the rim of the tank; and a second valve disposed in the fluid connection and operable to open to allow rinse fluid to flow from the second tank to the rim of the tank and operable to close to allow refilling of the second tank.

14 Claims, 7 Drawing Sheets

FLUSH RINSE APPARATUS FOR ELECTROPLATING OPERATIONS

STATEMENT OF GOVERNMENT INTEREST

The invention described herein may be manufactured and used by or for the Government of the United States of America for government purposes without the payment of any royalties thereof.

BACKGROUND OF THE INVENTION

The invention relates in general to an apparatus for conducting electroplating operations and in particular to an apparatus for rinsing electroplated articles or objects.

U.S. Pat. No. 4,269,208 issued on May 26, 1981 is hereby expressly incorporated by reference. U.S. Pat. No. 4,269,208 discloses an electroplating apparatus comprising a non-linear array of treating tanks having a central rinse tank. A plurality of showerheads are located around the rinse tank for spray rinsing articles in the rinse tank. A hoist or other apparatus is provided for moving the article or articles being treated from the treating or process tanks to the rinse tank. The discharge from the rinse tank flows to a two-way valve. In one position of the two-way valve, the rinse discharge flows to an ordinary sewer. In another position of the two-way valve, the rinse discharge flows to a set of concentrating tanks for concentrating the contaminants contained in the rinse discharge. Contaminants from the several treatment steps are not segregated, thereby complicating recovery operations for recovering any valuable contaminants. Further, the rinse tank itself is not fully cleaned after each rinse, further resulting in a mixing of contaminants in the rinse discharge water.

The present invention segregates the various contaminates from each treatment or process step, thereby resulting in a plurality of recovery tanks each containing only a single contaminant. Because each recovery tank contains only a single contaminant, the process of recovering that single contaminant, if desired, is simpler as compared to a recovery tank containing multiple contaminants. Furthermore, the present invention flushes the rinse tank each time an article is rinsed therein so that multiple contaminants are not mixed by virtue of residue remaining in the rinse tank. Further, the present invention permits a specific article to be immersed or submerged in a rinse fluid where different rinse fluid types may be used, for example, hot fluids, cold fluids, deionized water and non-aqueous based fluids. Further, the present invention includes a single rinse tank, which advantageously reduces precious manufacturing floor space. Accordingly, the present invention has a wide variety of commercial and non-commercial applications, including plating processes and electronics fabrication.

SUMMARY OF THE INVENTION

In the instant invention, after a part or article is treated, it is placed into the rinse tank that is filled with a rinse fluid, such as, typically, deionized water or, alternatively, a non-aqueous based fluid. After a length of time, the rinse tank is flushed (similar to a toilet flush) and the article is sprayed while the tank is being flushed. The rinse discharge goes to a recovery tank dedicated to one type of contaminant. The article is then placed in a process tank for further processing, or, if processing is finished, removed to another area.

Some advantages of the instant invention include: a single rinse tank usable for all processes; full control over rinse water quality at all times; rinse fluid may be hot for a certain operation then cold for another operation; compact size minimizes floor space; minimal distance between tanks minimizes oxidation during transfers; smooth flush tank minimizes cross contamination; rinse tank is filled by gravity (laminar flow) or pump to minimize fluid aeration; rinse tank is drained by gravity or pump; rinse tank waste fluid is diverted for recovery by type of contaminant; batch plating may be automated using rotary gantry with linear actuator wherein the position of the gantry is used to position the waste water diverter; multiple parts may be processed using different process steps for each part by utilizing a rotary robot.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
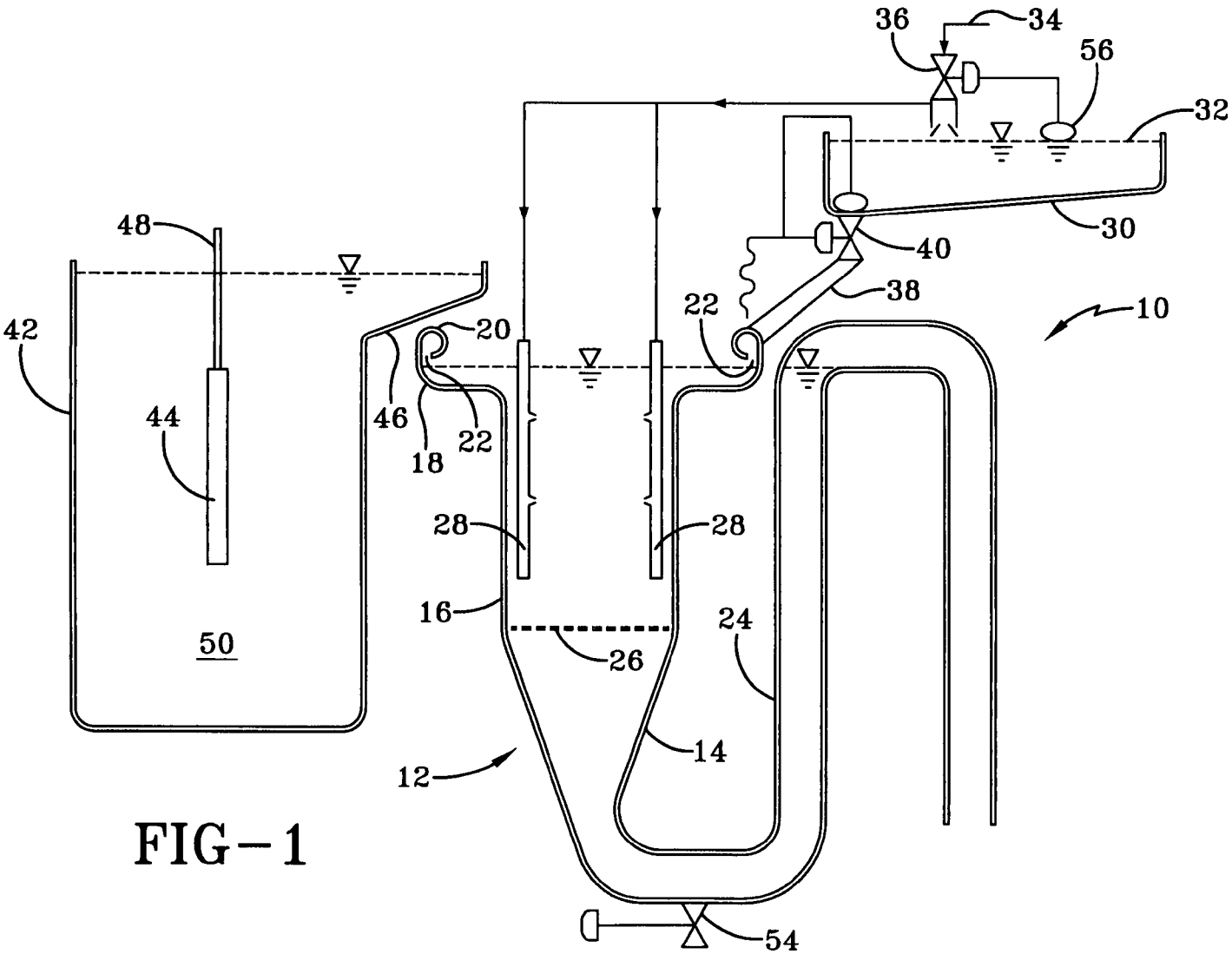
FIG. 1 is a schematic side view of one embodiment of a flush type rinse apparatus and process tank according to the invention.

FIG. 1 is a schematic side view of one embodiment of a flush type rinse apparatus 10 for rinsing an article 44, and a process tank 42. The apparatus 10 includes a rinse tank 12 having a bottom portion 14 with a generally conical shape, a middle portion 16 with a generally cylindrical shape and an upper portion 18 with a generally cylindrical shape. The diameter of the upper portion 18 is greater than the diameter of the middle portion 16. The upper portion 18 includes a rim 20 in the form of an arc. Rim 20 has a circumferential opening 22 through which a fluid, such as, typically, deionized water or, alternatively, a non-aqueous based fluid, leaves the rim 20 and enters upper portion 18 of tank 12.

A discharge pipe 24 in the form of a siphon tube is connected to the bottom portion 14 of the tank 12. A flush mounted valve or removable plug 54 is disposed in the discharge pipe 24 at the low point near where the discharge pipe 24 joins the bottom portion 14 of the tank 12, for cleanout purposes. A grate 26 is disposed at the bottom of the middle portion 16 to support article 44 and/or prevent articles from falling downward near the cleanout port. Article 44 may, for example, be supported from above without a grate. Grate 26 may also be in the form of an article support mesh basket.

A generally cylindrical spray assembly 28 is disposed in the middle portion 16. A second tank 30 holds a rinse fluid 32 (referred to as "fluid"), such as, typically, deionized water, or, alternatively, a non-aqueous based fluid. A source 34 of the fluid 32 is connected to the second tank 30 and to the spray assembly 28 through a valve 36. Valve 36 opens to allow flow of the fluid to both the second tank 30 and the spray assembly 28 when the level of the fluid 32 in the second tank 30 is decreasing. Valve 36 closes to stop the flow of the fluid to both the second tank 30 and the spray assembly 28 when the level of fluid 32 in the second tank 30 is at a full level.

A fluid connection 38, for example, a pipe, connects the second tank 30 and the rim 20 of the tank 12. A second valve 40 is disposed in the fluid connection 38 and is operable to open to allow fluid 32 to flow from the second tank 30 to the rim 20 of the tank 12 and is operable to close to allow refilling of the second tank 30. Disposed adjacent rinse tank 12 is one or more process tanks 42. Process tanks 42 are filled with a process chemical 50 appropriate for the particular process being carried out. Article 44 is immersed in chemical 50 while being held by an article holder 48. Process tank 42 includes a lip portion 46 that extend above and overlaps the upper portion 18 of the tank 12. The purpose of lip portion 46 is to catch chemical 50 that may drip from article 44 when it is removed from tank 42 and moved towards tank 12 for rinsing therein.

Figure 2:
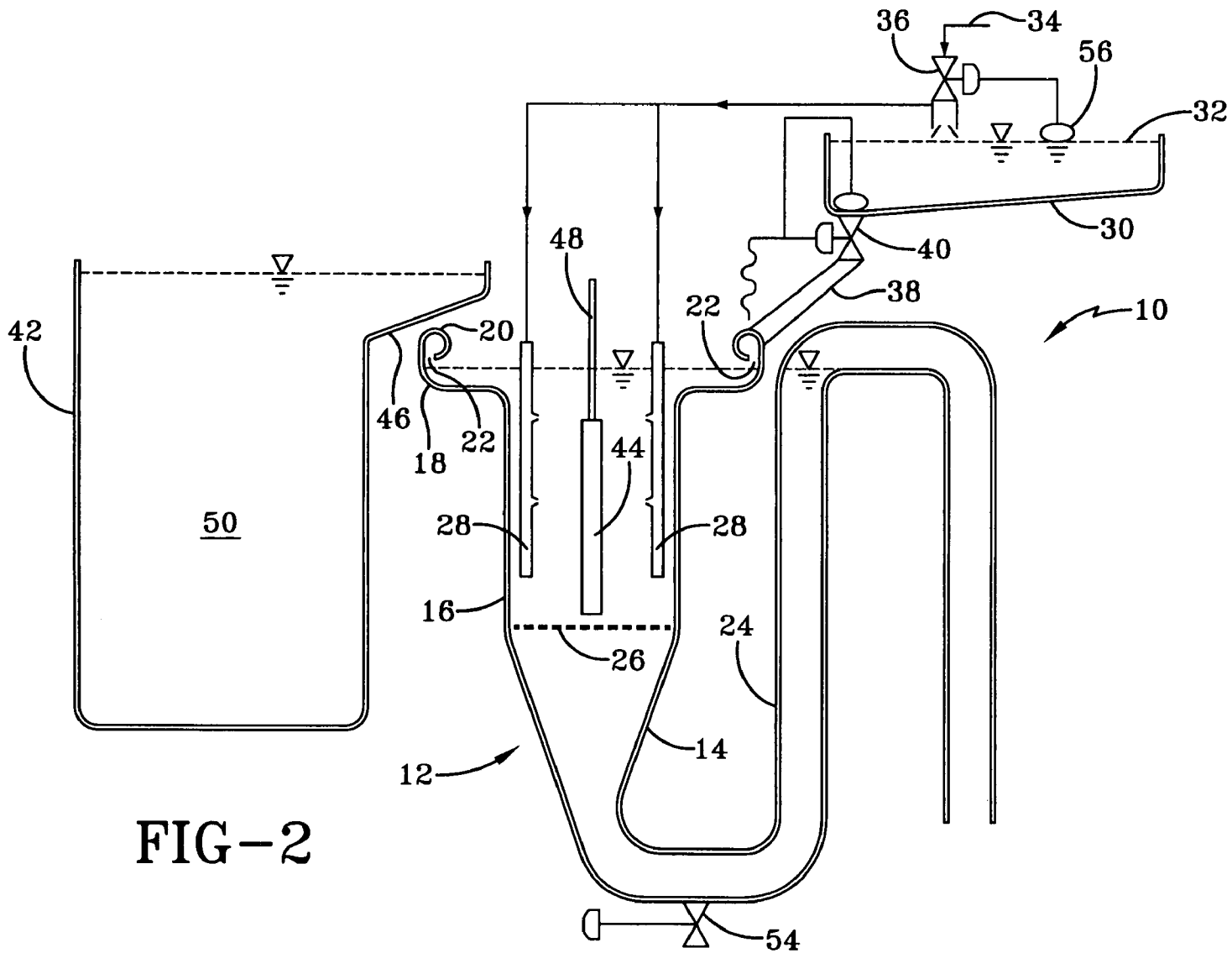
FIG. 2 is a schematic side view showing insertion of an article in the rinse tank.
Figure 3:
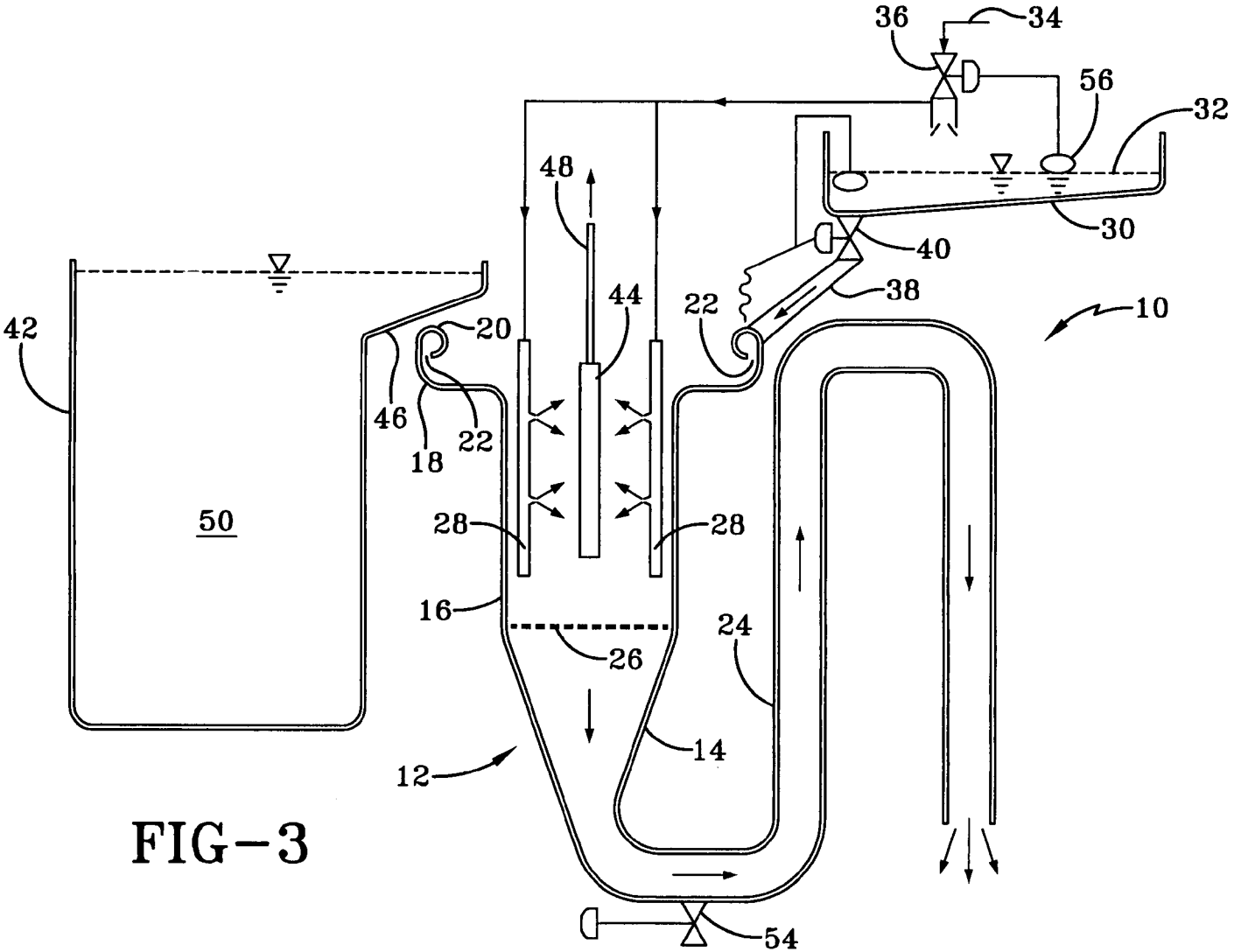
FIG. 3 is a schematic side view showing flushing of the rinse tank.

FIG. 1 also represents the first step, that is, dipping the article 44 in chemical 50, of a treatment process. FIG. 2 shows article 50 submerged in a fluid 32, typically, deionized water, or alternatively a non-aqueous based fluid, in rinse tank 12. FIG. 3 shows another step in the process, that is, flushing of tank 12 and simultaneous spraying of article 44 with a fluid 32.

Referring to FIG. 3, flushing of the rinse tank 12 begins by moving valve 40 from a closed to an open position thereby allowing fluid 32, typically, deionized water (referred to as "water"), from tank 30 to flow to rim 20 of tank 12. The fluid flows around rim 20 and is discharged into tank 12 through circumferential opening 22. The flow of fluid 32 into tank 12 causes the siphon discharge pipe 24 to fill, which starts water flowing out of tank 12 through discharge pipe 24. Valve 40 may be actuated manually or automatically, for example, under computer control. As seen in FIG. 3, as valve 40 is opened and the level of fluid 32, typically, water, in tank 30 begins falling, valve 36 begins to open by, for example, action of float 56.

Opening valve 36 allows fluid 32, typically water from a fluid source 34, typically a deionized water source, to flow into spray assembly 28 and tank 30. Spray assembly 28 includes a plurality of spray heads directed at article 44. The flow of fluid into tank 30 through valve 36 is smaller than the flow of fluid out of tank 30 through valve 40 such that tank 30 will become substantially empty. When tank 30 is substantially empty and tank 12 is again full, valve 40 is closed by, for example, action of a flapper valve or a solenoid connected to, for example, a computer. Closing valve 40 allows tank 30 to begin filling. As tank 30 reaches full capacity, valve 36 returns to a closed position thereby stopping the flow of fluid into tank 30 and into spray assembly 28. Those of skill in the art will recognize the sequence of events described above as similar to the flushing of modern toilets. Prior to tank 12 refilling, article 44 is removed from the tank so that article 44 does not contaminate the tank 12. Article 44 is then moved to another process tank or area for further processing or drying, for example.

Figure 4:
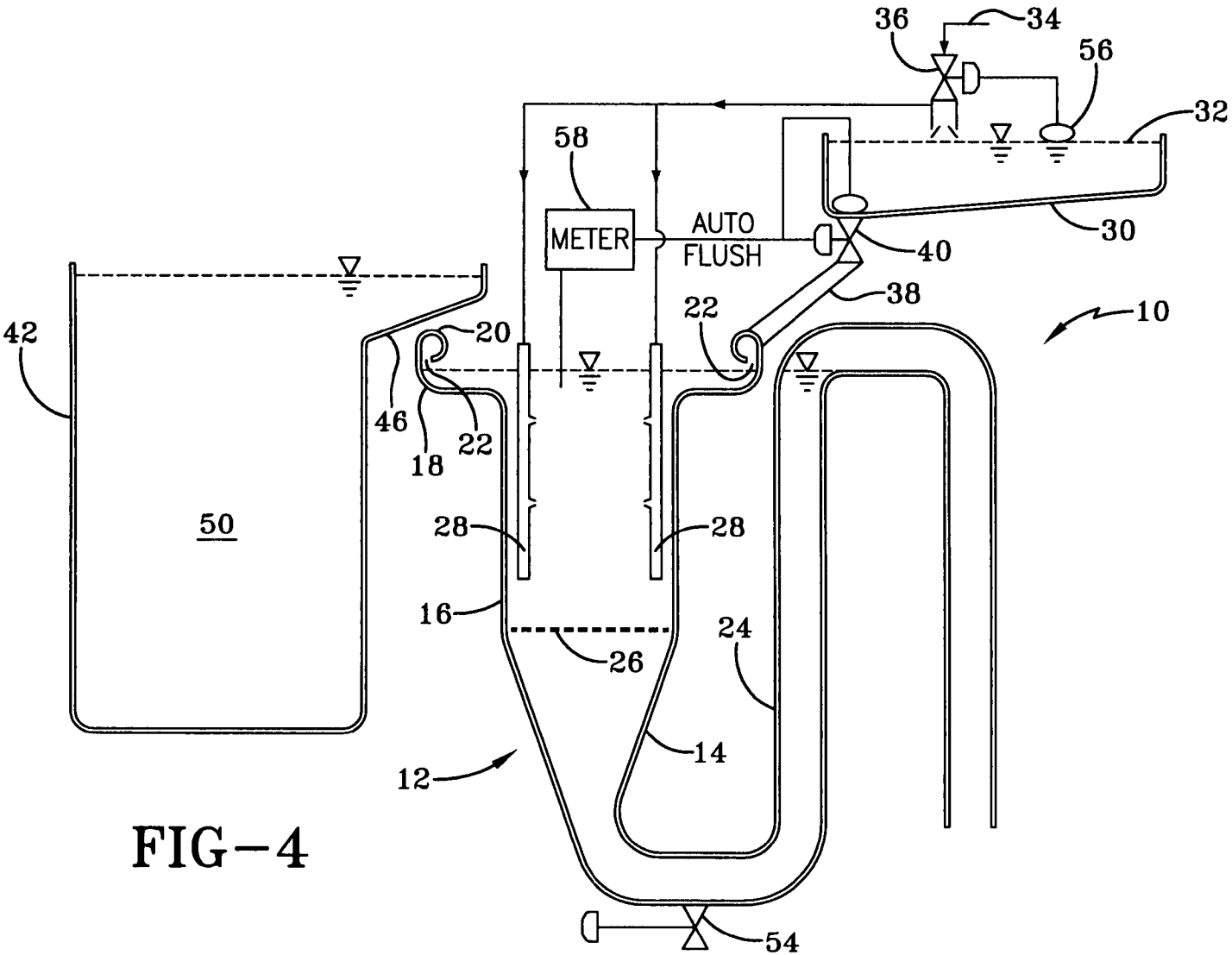
FIG. 4 is a schematic side view showing another embodiment of the invention.

If desired, rinse tank 12 may be flushed each time a new article 44 is placed therein. However, there may be situations where one may desire to flush tank 12 only when the concentration of a particular contaminant reaches or exceeds a preset level. In that case, and with reference to FIG. 4, a contamination meter 58 that measures the concentration of a particular contaminant is disposed in tank 12 and electrically connected to valve 40. When meter 58 senses that the concentration of contaminant has been reached, a signal is sent to valve 40 to begin the flushing sequence.

Figure 5:
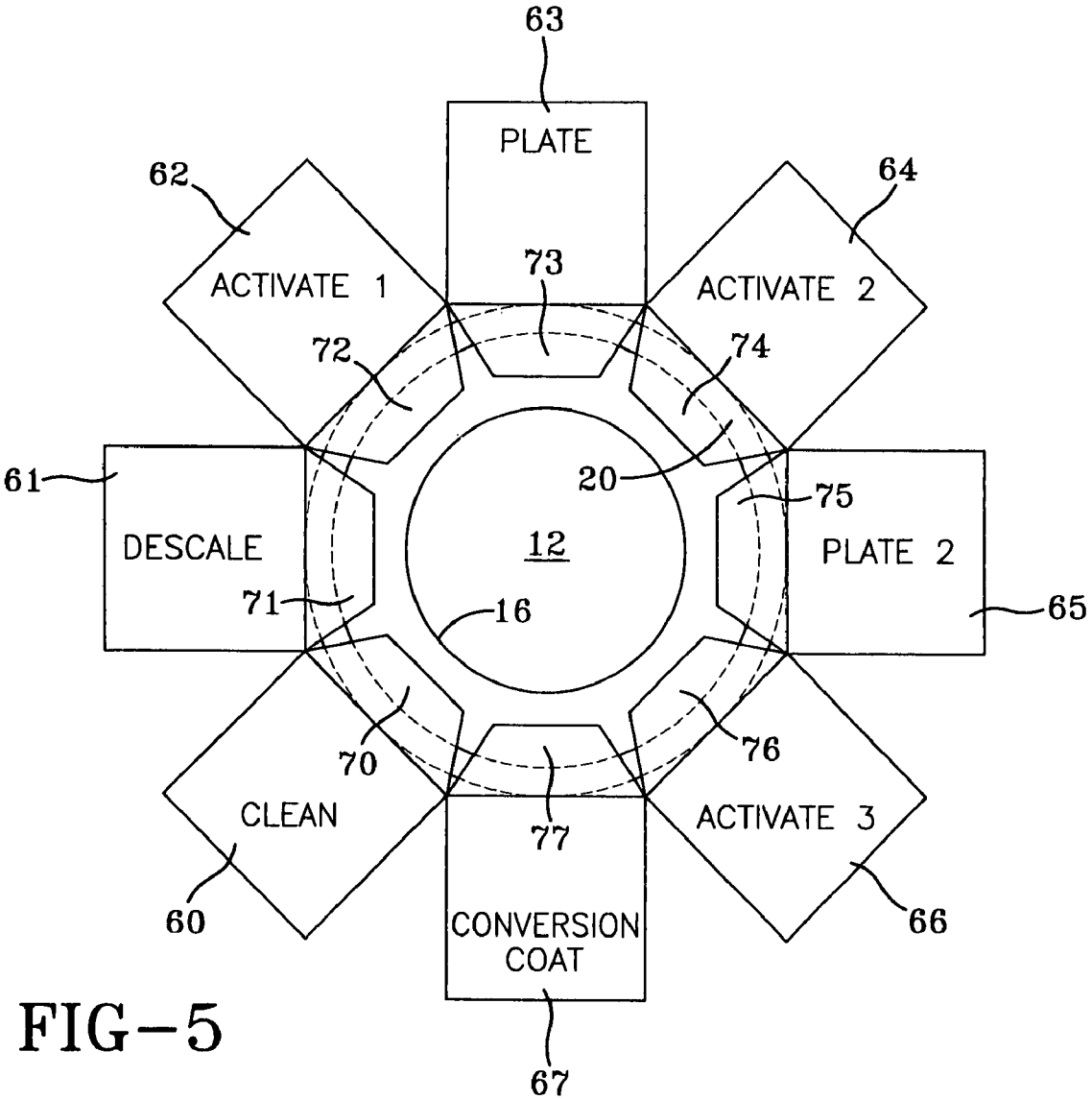
FIG. 5 is a schematic top view of yet another embodiment of the invention.

FIG. 5 is a schematic top view of an embodiment of the invention that includes a plurality of process tanks 60-67 disposed in a circular manner around rinse tank 12. Each process tank 61-67 includes a respective lip portion 70-77 that overlaps rinse tank 12. Any suitable type of process could be performed on an article 44 in the various process tanks 60-67. For example, in a plating process, tank 60 is a cleaning tank, tank 61 is a descaling tank, tank 62 is a first activation tank, tank 63 is a first plating tank, tank 64 is a second activation tank, tank 65 is a second plating tank, tank 66 is a third activation tank and tank 67 applies a conversion coat. After article 44 is treated in each tank, it is rinsed in rinse tank 12 before being placed in the next tank. The advantage of a single rinse tank 12 and the circular arrangement of tanks 60-67 is a large reduction in space required and the number of rinse tanks required. Also, the length of travel required to move an article 44 from one tank to the next is small, compared to conventional linear arrangements.

Figure 6:
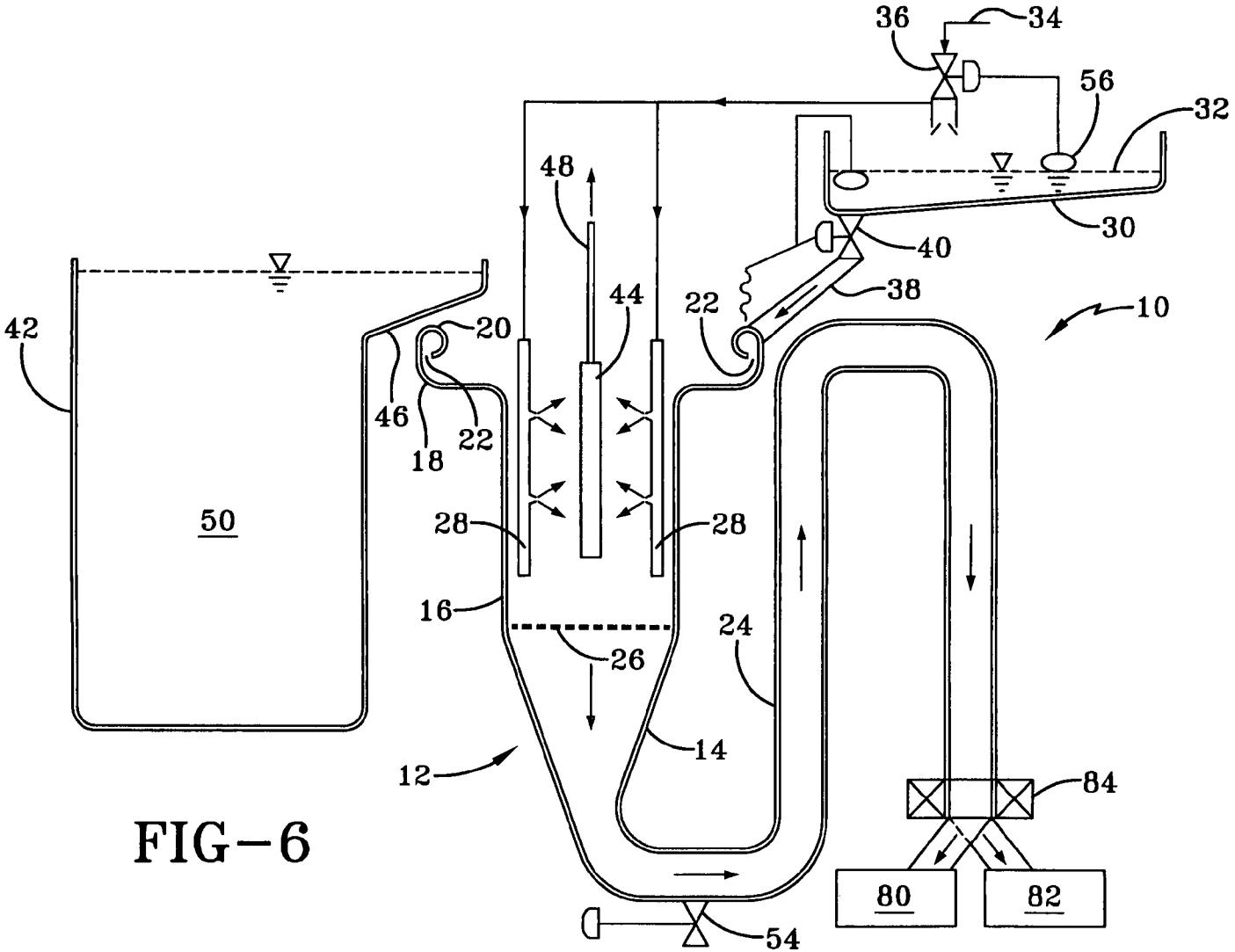
FIG. 6 is a schematic side view of another embodiment of the invention.

In many types of processes, the contaminants contained in the rinse water are valuable and worth recovery. However, recovery is best accomplished when only one contaminant is present in the recovery water. To that end, another embodiment, shown schematically in FIG. 6, includes a plurality of rinse discharge recovery tanks. While two tanks 80, 82 are shown, preferably, there is a separate recovery tank for each type of process being employed or type of contaminant that is desired to be recovered. A diverter valve 84 disposed in the discharge pipe 24 enables the rinse discharge flow to be diverted to any one of the plurality of recovery tanks.

Figure 7:
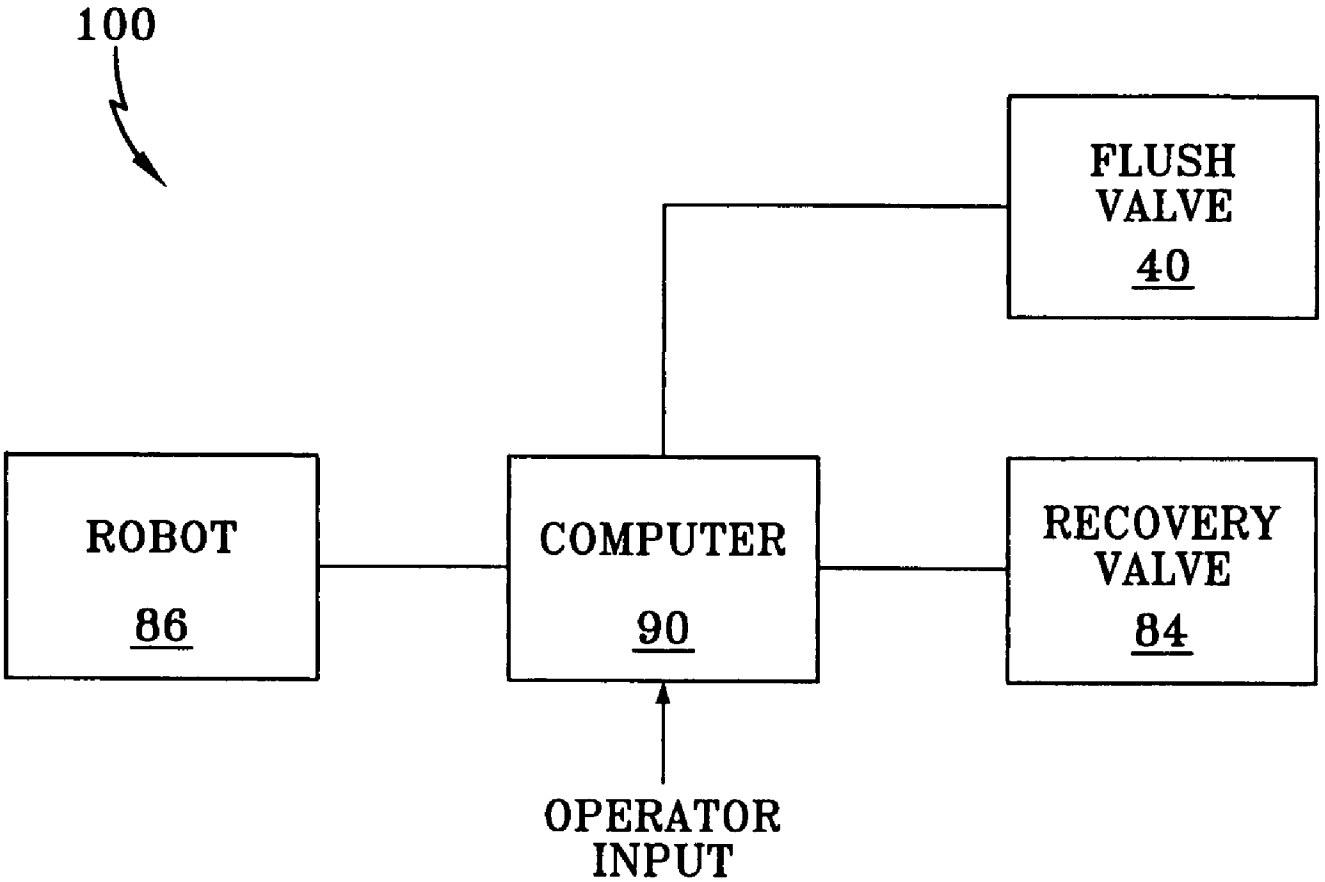
FIG. 7 is a schematic of an automatic process apparatus.

FIG. 7 is a schematic of an automatic process apparatus 100. The automatic process apparatus 100 includes all the components shown in FIG. 6, and, in addition, a robot 86 and computer 90. Robot 86 is typically mounted overhead the process and rinse tanks. Robot 86 is operable to move over each process tank and the rinse tank. Robot 86 includes a gripper arm for gripping the article 44. The gripper arm is operable to move up and down for inserting and removing article 44 from the process and rinse tanks. Such robots are known in the art. Robot 86 is connected to and controlled by computer 90. Computer 90 is connected to and controls the opening of flush valve 40 and the position of the recovery tank valve 84.

An operator inputs information into computer 90. Such information includes which process tanks will be utilized for which articles and in what order, when rinsing and flushing of each article should take place, and in what position the recovery tank valve 84 should be for each flushing operation. As an alternative, the computer could compute the order and times of processing. In this manner, the apparatus 100 can process several articles simultaneously. When the rinse tank is ready for flushing, computer 90 sends an open signal to flush valve 40, thereby beginning the rinse and flush operation. Just prior to the beginning of the flushing operation, the computer 90 sends a signal to recovery tank valve 84 to divert its flow, if necessary, to a position corresponding to the proper recovery tank for the contaminant being rinsed off the article 44.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus for rinsing an article, comprising:

a rinse tank surrounding the article for immersion, the rinse tank comprises a Y-shaped bottom portion having a generally conical shape where at least one type of rinse fluid exits through the Y-shaped bottom portion into a discharge pipe, which contacts the Y-shaped bottom portion, a middle portion having a generally cylindrical shape and an upper portion having a generally cylindrical shape, wherein the upper portion includes a diameter larger than a diameter of the middle portion, wherein the upper portion includes a rim in the form of an arc, and wherein the discharge pipe is in a form of a siphon tube connected to the Y-shaped bottom portion of the rinse tank;

a generally cylindrical spray assembly being disposed in the middle portion;

a second tank for holding at one time said at least one type of rinse fluid;

a source of said at least one type of rinse fluid being connected to the second tank and to the spray assembly through a valve, the valve is operable to open to both the second tank and the spray assembly when a level of said at least one type of rinse fluid in the second tank is decreasing and operable to close to both the second tank and the spray assembly when the level in the second tank is at a full level;

a fluid connection being between the second tank and the rim of the rinse tank; and a second valve being disposed in the fluid connection and operable to open to allow said at least one type of rinse fluid to flow from the second tank to the rim of the rinse tank and operable to close to allow refilling of the second tank, wherein the rinse tank is a smooth rinse tank where said at least one type of rinse fluid type is removed from the smooth rinse tank by a flushing action of said discharge pipe, said discharge pipe is a siphon discharge pipe connected to the rinse tank, and wherein an upper level of the siphon discharge pipe is substantially adjacent to an upper level of the rinse tank for self leveling the rinse tank.

2. The apparatus of claim 1, further comprising an article support grate disposed at a bottom of the middle portion.

3. The apparatus of claim 1, further comprising a process tank being disposed adjacent the rinse tank, the process tank includes a lip portion that overlaps the rinse tank.

4. The apparatus of claim 1, further comprising a contamination meter being disposed in the rinse tank and operable to measure a concentration of a contaminant in the rinse tank, the meter is electrically connected to the second valve and operable to open the second valve when the concentration of the contaminant at least meets a predetermined level.

5. The apparatus of claim 1, further comprising a plurality of process tanks being disposed in a substantially circular manner around the rinse tank, each process tank includes a lip portion, which overlaps the rinse tank.

6. The apparatus of claim 5, further comprising a plurality of rinse discharge recovery tanks being connected to the discharge pipe;

a diverter valve being disposed in the discharge pipe and selectively positionable to direct rinse discharge flow from the rinse tank to any one of the plurality of rinse discharge recovery tanks;

a robot being mounted overhead the rinse tank and the plurality of process tanks and movable over the rinse tank and the plurality of process tanks for inserting and removing articles therein; and a computer being connected to the robot, the discharge valve and the second valve, the computer controls the robot for positioning and insertion and removal of articles in the rinse tank and the plurality of process tanks and the computer also controls an opening of the second valve and a selectable position of the discharge valve, the selectable position of the discharge valve depends upon a contaminant being rinsed in the rinse tank.

7. The apparatus of claim 1, further comprising a plurality of rinse discharge recovery tanks being connected to the discharge pipe; and a diverter valve being disposed in the discharge pipe and selectively positionable to direct rinse discharge flow from the rinse tank to any one of the plurality of rinse discharge recovery tanks.

8. The apparatus according to claim 1, wherein said rinse fluid comprises deionized water.

9. The apparatus according to claim 1, wherein said rinse fluid comprises a non-aqueous based fluid.

10. An apparatus, comprising:

a rinse tank surrounding the article for immersion, the rinse tank comprises a Y-shaped bottom portion having a generally conical shape where at least one type of rinse fluid exits through the Y-shaped bottom portion into a discharge pipe, which contacts the Y-shaped bottom portion, a middle portion having a generally cylindrical shape and an upper portion having a generally cylindrical shape, wherein the upper portion includes a diameter larger than a diameter of the middle portion, wherein the upper portion includes a rim in the form of an arc, and wherein the discharge pipe is in a form of a siphon tube connected to the Y-shaped bottom portion of the rinse tank;

a generally cylindrical spray assembly being disposed in the middle portion;

a second tank for holding at one time said at least one type of rinse fluid;

a source of said at least one type of rinse fluid being connected to the second tank and to the spray assembly through a valve, the valve being operable to open to both the second tank and the spray assembly when a level of said at least one type of rinse fluid in the second tank is decreasing and operable to close to both the second tank and the spray assembly when the level in the second tank is at a full level;

a fluid connection being between the second tank and the rim of the rinse tank;

a second valve being disposed in the fluid connection and operable to open to allow said at least one type of rinse fluid to flow from the second tank to the rim of the rinse tank and operable to close to allow refilling of the second tank; and a plurality of process tanks being disposed in a substantially circular manner around the rinse tank, where each of said plurality of process tanks includes a lip portion that overlaps the rinse tank, wherein the rinse tank is a smooth rinse tank where said at least one type of rinse fluid type is removed from the smooth rinse tank by a flushing action of said discharge pipe, said discharge pipe is a siphon discharge pipe connected to the rinse tank, and wherein an upper level of the siphon discharge pipe is substantially adjacent to an upper level of the rinse tank for self leveling the rinse tank.

11. The apparatus according to claim 10, wherein said rinse fluid comprises deionized water.

12. The according to claim 10, wherein said rinse fluid comprises a non-aqueous based fluid.

13. An apparatus, comprising:

a rinse tank surrounding the article for immersion, the rinse tank comprises a Y-shaped bottom portion having a generally conical shape where at least one type of rinse fluid exits through the Y-shaped bottom portion into a discharge pipe, which contacts the Y-shaped bottom portion, a middle portion having a generally cylindrical shape and an upper portion having a generally cylindrical shape, wherein the upper portion includes a diameter larger than a diameter of the middle portion, wherein the upper portion includes a rim in the form of an arc, and wherein the discharge pipe is in a form of a siphon tube connected to the Y-shaped bottom portion of the rinse tank;

a generally cylindrical spray assembly being disposed in the middle portion;

a second tank for holding at one time said least one type of rinse fluid;

a source of the rinse fluid being connected to the second tank and to the spray assembly through a valve, the valve being operable to open to both the second tank and the spray assembly when a level of said at least one type of rinse fluid in the second tank is decreasing and operable to close to both the second tank and the spray assembly when the level in the second tank is at a full level;

a fluid connection being between the second tank and the rim of the rinse tank;

a second valve being disposed in the fluid connection and being operable to open to allow said at least one type of rinse fluid to flow from the second tank to the rim of the rinse tank and being operable to close to allow refilling of the second tank;

a plurality of process tanks being disposed in a substantially circular manner around the rinse tank, where each of said plurality of process tanks includes a lip portion that overlaps the rinse tank;

a plurality of rinse discharge recovery tanks being connected to the discharge pipe;

a diverter valve being disposed in the discharge pipe and selectively positionable to direct rinse discharge flow from the tank to any one of the plurality of rinse discharge recovery tanks;

a robot being mounted overhead the tank and the plurality of process tanks and movable over the rinse tank and the plurality of process tanks for inserting and removing articles therein; and a computer connected to the robot, the discharge valve and the second valve, the computer controls the robot for positioning and insertion and removal of articles in the rinse tank and the plurality of process tanks and the computer also controls an opening of the second valve and a selectable position of the discharge valve, the selectable position of the discharge valve depending upon a contaminant being rinsed in the rinse tank, wherein the rinse tank is a smooth rinse tank where said at least one type of rinse fluid type is removed from the smooth rinse tank by a flushing action of said discharge pipe, said discharge pipe is a siphon discharge pipe connected to the rinse tank, and wherein an upper level of the siphon discharge pipe is substantially adjacent to an upper level of the rinse tank for self leveling the rinse tank.

14. The apparatus according to claim 13, further comprising a contamination meter is disposed in the rinse tank, the contamination meter is electrically connected to the second valve.

* * * * *